US010161397B2

(12) United States Patent
Dicks et al.

(10) Patent No.: US 10,161,397 B2
(45) Date of Patent: Dec. 25, 2018

(54) ECCENTRIC SCREW PUMP WITH SPLIT STATOR HOUSING

(71) Applicant: SEEPEX GmbH, Bottrop (DE)

(72) Inventors: Norman Dicks, Geldern (DE); Julian Harking, Bottrop (DE); Oliver Stumpf, Bottrop (DE)

(73) Assignee: SEEPEX GMBH, Bottrop (DE)

( * ) Notice: Subject to any disclaimer, the term of this patent is extended or adjusted under 35 U.S.C. 154(b) by 100 days.

(21) Appl. No.: 15/503,660

(22) PCT Filed: Jul. 30, 2015

(86) PCT No.: PCT/EP2015/067568
§ 371 (c)(1),
(2) Date: Feb. 13, 2017

(87) PCT Pub. No.: WO2016/034341
PCT Pub. Date: Mar. 10, 2016

(65) Prior Publication Data

US 2017/0268505 A1 Sep. 21, 2017

(30) Foreign Application Priority Data

Sep. 1, 2014 (DE) ..... 10 2014 112 552

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 2/107*** | (2006.01) |
| ***F04C 28/18*** | (2006.01) |
| ***F04C 14/20*** | (2006.01) |
| ***F04C 18/107*** | (2006.01) |
| ***F04C 28/20*** | (2006.01) |

(52) U.S. Cl.
CPC ..... *F04C 2/1075* (2013.01); *F04C 2/1071* (2013.01); *F04C 14/20* (2013.01); *F04C 18/107* (2013.01); *F04C 28/18* (2013.01); *F04C 28/20* (2013.01); *F04C 2230/60* (2013.01)

(58) Field of Classification Search
CPC ..... F04C 2/1071; F04C 2/1075; F04C 14/20; F04C 18/107; F04C 18/1075; F04C 28/18; F04C 28/20; F04C 2230/60
USPC ..... 418/48, 152, 153, 1
See application file for complete search history.

(56) References Cited

U.S. PATENT DOCUMENTS 6,358,027 B1 3/2002 Lane
6,666,668 B1 * 12/2003 Kaechele ..... F04C 2/1075 418/48

(Continued)

*Primary Examiner* — Theresa Trieu
(74) *Attorney, Agent, or Firm* — Andrew Wilford

(57) ABSTRACT

An eccentric screw pump has at least one stator of elastic material and extending along an axis, a rotor rotatable about the axis in the stator, and an axially split stator housing at least partially surrounding the stator and, formed by at least two housing segments. A stator-clamping device presses the housing segments radially against the stator and thereby presses the stator against the rotor. It has one or more movable adjusting elements that bear radially inward on the housing segments for radially adjusting and clamping the stator and one or more actuators connected or provided with the adjusting elements for automatically positioning the housing segments.

11 Claims, 6 Drawing Sheets

(56) References Cited

U.S. PATENT DOCUMENTS

| | | | | |
|---|---|---|---|---|
| 8,439,659 | B2 | 5/2013 | Loeker | |
| 2006/0073032 | A1* | 4/2006 | Parrett | F04C 2/1075 418/48 |
| 2009/0110579 | A1* | 4/2009 | Amburgey | F04C 2/1075 418/48 |
| 2012/0063941 | A1* | 3/2012 | Overmeier | F04C 2/1073 418/48 |

* cited by examiner

ECCENTRIC SCREW PUMP WITH SPLIT STATOR HOUSING

CROSS REFERENCE TO RELATED APPLICATIONS

This application is the US-national stage of PCT application PCT/EP2015/067568 filed 30 Jul. 2015 and claiming the priority of German patent application 102014112552.5 itself filed 1 Sep. 2014.

FIELD OF THE INVENTION

The invention relates to an eccentric screw pump having at least one stator of elastic material and a rotor rotatable or mounted to rotate in the stator and surrounded at least in some regions by a stator casing, also referred to as a stator housing, the stator housing being axially split and being formed by at least two housing segments so as to form a stator-clamping device that can press the stator radially against the rotor.

BACKGROUND OF THE INVENTION

In such an eccentric screw pump, the rotor is normally connected with the drive or drive shaft by at least one coupling rod, also referred to as an articulated shaft. The pump has an intake fitting as well as an output fitting, and the stator is connected with a connection flange of the intake fitting with its one end, and with a connection flange of the output fitting with its other end. Elastic material particularly means an elastomer, for example a (synthetic) rubber or a rubber mixture. Furthermore, composite materials composed of an elastomer or another material, for example metal, are also included. Preferably, the (elastomeric) stator is an axially split stator formed by at least two stator shells. In such an eccentric screw pump, the (split) stator is replaceable separately from the stator housing, and consequently is not permanently connected with the stator housing, particularly not one piece therewith. In this way, the possibility exists of replacing the elastomeric stator separately from the stator housing, specifically without complicated disassembly of the pump being necessary. Preferably, the stator is formed by two stator half-shells. The stator housing is formed by at least two housing segments, for example three housing segments or at least four housing segments that form a stator-clamping device. In this regard, the stator or the stator shells lies/lie against complementary seal faces on the respective housing part (intake fitting or output fitting) or against complementary adapters, with seal faces on the ends. Adjusting elements, for example adjusting screws, are provided for clamping the stator; these act on the housing segments or on their end clamping flanges radially, for example, so that the housing segments can be pressed against the stator radially using these clamping screws.

An eccentric screw pump of the type described initially is known from WO 2009/024279 [U.S. Pat. No. 8,439,659], for example. The housing segments of the stator housing have attachment flanges on the end that are connected with the connection flange of the intake fitting or output fittings or with separate adapters using clamping means, for the purpose of clamping the stator. These clamping means or adjusting means are adjusting screws that are essentially oriented radially. The known eccentric screw pump has proven itself outstanding in practice. The fact that the stator can be re-clamped is particularly advantageous, so that after a certain amount of wear, for example, adjustment and thereby optimization of operation is possible. Proceeding from this, the known measures are capable of being developed further. This is where the invention takes its start.

OBJECT OF THE INVENTION

The object of the invention is to provide an eccentric screw pump of the type described above but having improved adjusting and/or clamping possibilities.

SUMMARY OF THE INVENTION

To attain this object, the invention teaches, in the case of an eccentric screw pump of the type described above that the stator-clamping device has one or more actuators that are connected with the adjusting elements or equipped with the adjusting elements for automated advancing of the stator. Preferably, the actuators are connected with a controller or equipped with a controller, and the actuators can be driven by the controller as a function of status data or operating parameters of the eccentric screw pump. Such status data or operating parameters can be made available directly by the pump or the pump controller, for example. Thus, the controller can be connected with the pump drive or the pump drive controller, for example, or can be integrated into it, and the actuators can be driven by the controller as a function of the power consumed by the drive motor or of the motor current, for example. In addition or alternatively, control can also take place as a function of other parameters, for example of the counter-pressure and/or the volume stream. In addition or optionally, sensors can be integrated into the eccentric screw pump and connected with the controller so that the actuators can be driven by the controller as a function of measurement values that are recorded by the sensors, for example temperature values and/or pressure values. However, it is also possible to use sensors that are not an integral part of the pump itself, but rather are integrated into the system as a whole and are provided upstream and/or downstream of the pump, for example. Thus, the conveyed fluid can be determined using a through-flow volume meter downstream of the pump, or the counter-pressure can also be determined with a pressure sensor downstream of the pump.

In this regard, the invention proceeds from the recognition that the function, the operation and/or the durability of an eccentric screw pump or its components can be optimized if manual adjustment of the stator is replaced or at least supplemented with automated adjustment. The adjusting elements with which the stator is adjusted or reclamped are consequently no longer actuated (only) by suitable tools, but rather the stator-clamping device is equipped with actuators that allow automated positioning.

In this way, first of all the possibility exists of adjusting the stator automatically, i.e. not manually, using the drives, after a specific period of operation. This procedure can be triggered in targeted manner by an operator, for example at specific time intervals or if decreasing efficiency is reported, etc. Particularly preferably, however, automatic adjustment takes place with automatic control, as a function of status data or operating parameters of the eccentric screw pump. Thus, the possibility exists of constantly operating the pump at an optimal degree of efficiency when operating conditions change, specifically preferably in the sense of control with or without feedback. The controller can consequently operate the actuators at intervals or continuously, in the sense of control with or without feedback as a function of status data or operating parameters. In this regard, the degree of efficiency of the pump can be constantly determined and monitored by the power consumed by the drive motor, the counter-pressure and/or volume stream. In the case of a deviation from the optimal degree of efficiency, the positioning of the pump can be changed automatically. Thus, the hydraulic power of the pump results from the conveyed amount and the counter-pressure or difference pressure. Both parameters can be recorded and the hydraulic power can be determined from them. This hydraulic power can then be compared with the drive power of the pump, and the total degree of efficiency can be derived from this. Optionally, other advantages can also be achieved, along with constant control to the optimal degree of efficiency. If, for example, the smallest possible drive power is to be used, then the controller can be designed for a specific maximally permissible startup moment. By opening or relieving stress on the stator during startup, startup moments and operating moments can be reduced, for example, and thereby operation and the useful lifetime of the pump can be improved. Furthermore, control of the positioning can take place as a function of the temperature of the stator, by temperature measurements at the stator; for example, the positioning can be restricted in the case of a maximally allowed stator temperature. In this way, the stator service life can be extended.

Consequently, the core of the present invention is the actuators with which the housing segments can automatically be actuated radially for clamping or adjusting the stator. Such actuators can be electrical or electric motor drives, for example. Alternatively, hydraulic drives, for example hydraulic cylinders, or pneumatic drives, for example pneumatic cylinders, can be used.

Actuators can be combined with the most varied mechanical stator-clamping devices of the eccentric screw pump.

Thus, the invention can be implemented with the concept known from WO 2009/024279 [U.S. Pat. No. 8,439,659], for example, in which the adjusting elements acting on the housing segments are adjusting screws and, at the same time, radial clamping screws. Separate drives, for example electric motors, can be connected with these adjusting screws for example such that the drives actuate the adjusting screws radially. Alternatively, the possibility exists of replacing these known adjusting screws with driven adjusting elements, for example stepper motors or hydraulic or pneumatic cylinders. In the case of a hydraulic or pneumatic cylinder, the piston of the cylinder, for example, can form the adjusting element that acts on the housing segment. A stepper motor, for example, can act on a respective adjusting element that replaces the adjusting screw.

In an alternative embodiment, clamping of the stator does not take place by adjusting elements that can be actuated radially, for example by adjusting screws, but rather by clamping elements that can be displaced axially or parallel to the axis, for example a clamping ring that can be displaced axially or multiple clamping segments that can be displaced axially. In such an embodiment, the housing segments each have a clamping flange with first clamping surfaces on the end, and one or more clamping elements that can be displaced axially, for example a clamping ring or multiple clamping segments, having second clamping surfaces, are set onto the clamping flange or the clamping flanges, and the first clamping surfaces and the second clamping surfaces are configured in such a manner and interact in such a manner that the stator housing can be pressed radially against the stator during an axial displacement of the clamping elements. In this regard, the first clamping surfaces and/or the second clamping surfaces are wedges. The clamping elements are then configured to be frustoconical, for example inner cones. The clamping flanges are configured to be complementarily frustoconical, for example outer cones. Preferably, both the first clamping surfaces and the second clamping surfaces are wedges that then lie against one another at a common contact surface, if applicable. However, the contact of the two clamping surfaces, for example wedges, can also be restricted to linear contact. Adjustment takes place by axial displacement of the clamping ring or the clamping segments, and deflection of the axial force, turning it into a radial force, takes place by the clamping surfaces or wedges. This embodiment, with clamping ring or clamping segments, opens up further optimization of automatic positioning.

Thus, first of all the possibility exists that in this embodiment, as well, adjusting screws are provided as adjusting elements that then, however, act on the axially displaceable clamping ring or the axially displaceable clamping elements axially. In this case, once again the drives already mentioned above in connection with adjusting screws can be used, and the adjusting screws can then also be replaced with adjusting elements of the drives, so that the actuators are equipped with adjusting elements.

In a further development of the wedge principle with clamping ring or clamping segments, the possibility also exists that the two clamping rings of the pump that lie opposite one another are connected with one another through clamping levers. Thus, one or more clamping levers can be connected at every clamping ring, and the clamping levers (in pairs) are connected with one another through a common activation lever, for example. Then a drive can act on this activation lever. Alternatively, the activation levers that are connected with the clamping rings can be actuated by separate drives that are supported on a base plate of the pump or a housing part, for example. Finally, the possibility exists of coupling the two clamping rings with one another directly, by linear motors, and of clamping them against one another in this manner, too.

In a further embodiment, the possibility exists that the clamping ring itself is maintained to be rotatable, as a rotatable clamping ring, and is axially displaced within the rotation. This can be implemented, for example, in that the clamping ring is guided on the respective housing part above the connection adapter, by a screwthread, in that the housing part or the connection adapter is provided with an outside thread and the clamping ring is provided with a complementary inside thread, for example. On rotation of the clamping ring on the housing part, this ring is then simultaneously displaced axially in the sense of positioning. According to such an embodiment, the clamping ring can then be provided with gear teeth on its outer periphery on which an electric motor drive, for example, then acts with a drive pinion. Alternatively, this embodiment can also be configured in such a manner that it is not the clamping ring itself that has the wedges, that is provided with an inside thread and/or outside thread, but rather a separate adjusting ring or positioning ring provided with the threads and gear teeth described, and that the clamping ring is either rotationally coupled with the adjusting ring or also is provided so as to rotate relative to the adjusting ring, so that, on rotation of the adjusting ring, the clamping ring is not rotated, but rather only displaced axially.

Alternatively, a rotatable adjusting ring can displace the clamping ring when rotated in that the adjusting ring and the clamping ring are provided with angled faces that are complementarily coordinated with one another. Thus, the adjusting ring can have one or more angled faces or slanted positioning surfaces on the surface facing the clamping ring and/or the clamping ring can have (complementary) angled faces or slanted surfaces on the surface facing the adjusting ring, so that the angled complementary faces, if applicable, the "total thickness" of adjusting ring, on the one hand, and clamping ring, on the other hand, changes on rotation of the adjusting ring, and thereby the clamping ring is displaced axially. In this regard, reference is made to the drawing. In this embodiment, too, a drive can act directly on the adjusting ring, for example via complementary gear teeth.

Alternatively, it lies within the scope of the invention that once again, a linear adjusting element acts on the adjusting ring tangentially, for example an adjusting screw that actuates the adjusting ring tangentially, and the adjusting screw or a similar linear adjusting element is driven by the drive.

Alternatively, the adjusting ring can also be provided with recesses that are structured as guide tracks, and rolling bodies or sliding bodies, for example balls, are held in these recesses or guide tracks, and these bodies, for example balls, act on the clamping element, for example the clamping ring, and press it down. The guide tracks or recesses are configured as cams, for example, i.e. they have a depth that decreases over its length (i.e. angularly of the ring). On rotation of such an adjusting ring, the bodies, for example balls, then migrate in these recesses that are increasingly shallow, so that the balls are moved axially during the rotation, and thereby actuate the clamping ring axially. Particularly preferably, the recesses are arcuate pockets or grooves that have a depth that decreases angularly from one end to the other end. The possibility exists that such recesses are provided only in the adjusting ring. Preferably, however, complementary recesses are also provided in the clamping ring, so that the rolling bodies, for example balls, are then guided in complementary recesses of the adjusting ring as well as of the clamping ring.

BRIEF DESCRIPTION OF THE DRAWING

In the following, the invention will be explained in greater detail with reference to a drawing that shows a single embodiment. In the drawing.

SPECIFIC DESCRIPTION OF THE INVENTION

Figure 1:
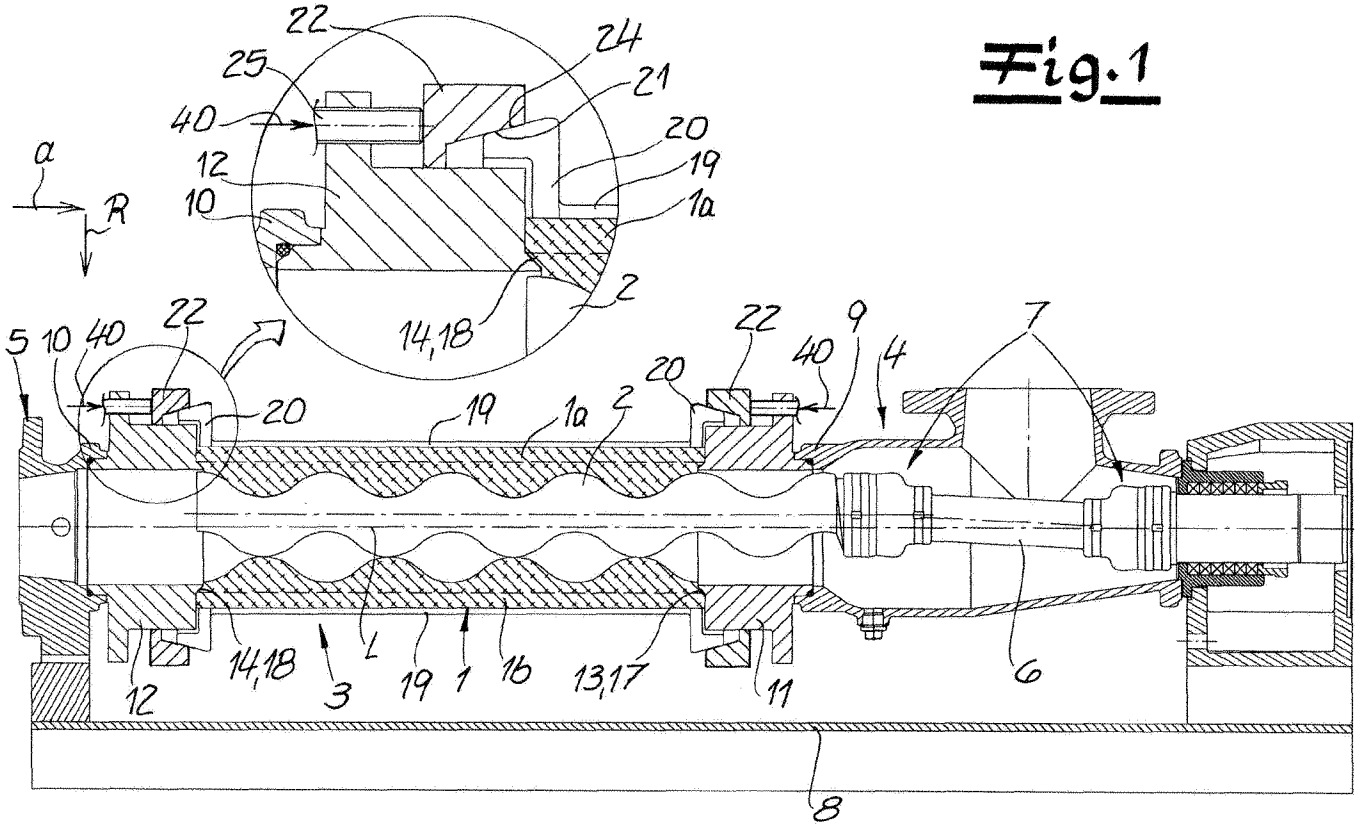
FIG. 1 is a section through an eccentric screw pump according to the invention in a first embodiment.

In the figures, an eccentric screw pump is shown that basically comprises a stator 1 of an elastic material and a rotor 2 mounted in the stator 1, the stator 1 being at least partially surrounded by a stator housing 3. Furthermore, the pump has an intake fitting 4 as well as an output fitting 5, also referred to as a pressure connector. An unillustrated pump drive is also provided with and the pump drive acts on the rotor 2 through a coupling rod 6. The coupling rod is connected between the rotor 2 and a drive shaft through couplings 7. The pump is usually mounted on a base plate 8 that can be supplied with the pump or also a base plate 8 of the user. The stator 1 is connected in known manner with a connection flange 9 of the intake fitting at its upstream end and with a connection flange 10 of the output fitting 5 at its downstream end. In this regard, connection does not take place directly to these connection flanges 9 and 10 here shown, but rather with the interposition of respective adapters 11 and 12. These adapters 11 and 12 are also referred to as centering rings or segment holders.

The stator 1 is an axially split stator and for this purpose here is formed by two half shells 1*a* and 1*b* that each extend over an angle of 180°. Axially split means subdivided along a stator axis L or parallel to it. The split plane between the half shells consequently runs parallel to the axis L. This axially split embodiment of the elastomeric stator makes it possible to disassemble and assemble the stator 1 while the intake fitting 4, an output 5, and rotor 2 are mounted in place. In this regard, reference is made to WO 2009/024279 [U.S. Pat. No. 8,439,659].

In order to guarantee a perfect seal in spite of this split method of construction, the stator 1 and its half shells 1*a* and 1*b* have seal faces 13 and 14 on their ends. The half shells 1*a* and 1*b* can be set onto stator holders with their end seal faces 13 and 14, and these stator holders are provided on the adapters 11, 12 in the embodiment shown here. The adapters 11 and 12 can be set into known holders of the intake fitting 4 and an output fitting 5 so that the intake fitting 4 and the output fitting 5 can be of conventional construction. The end seal faces 13 and 14 of the stator are be frustoconical or as frustoconical housing segments, specifically in the "inner cone" embodiment. The stator holders also have complementary frustoconical seal counter faces 17 and 18 that here are outer cones. Sealing takes place via rubber squeezing. Fixation and sealing of the half shells 1*a* and 1*b* takes place using the stator housing 3. It is an axially split housing and for this purpose has multiple housing segments 19, here four. This stator housing 3 with its housing segments 19 forms a stator-clamping or -adjustment apparatus with which the axially split stator 1 can be both fixed in place and sealed and a desired prestress or bias can be set in the stator 1.

For this purpose, the housing segments 19 have clamping flanges 20 on their ends that have first clamping surfaces 21 that are here wedges. Clamping elements 22 set onto the clamping flanges 20 are here clamping rings and provided with second clamping surfaces 24 that are also wedges. The first clamping surfaces 21 and the second clamping surfaces 24 are now configured in such a manner and interact in such a manner that the stator housing 3, 19 is radially clamped against the stator 1 on axial displacement of the clamping elements or clamping rings 22. The clamping ring 22 shown here can also be replaced with individual clamping segments, so that the individual clamping segments then form an interrupted clamping ring, so to speak. Such an embodiment is not shown in the figures, but the explanations in the figure description apply analogously.

Here according to FIG. 1, the clamping element is provided as a annularly continuous clamping ring 22 that has a annular second clamping surface 24 (on the inside), and this second clamping surface interacts with the first clamping surfaces 21 of the housing segments 19. In FIG. 1, it can be seen that during movement of the clamping ring 22 in axial direction a, a clamping force that acts in a radial direction R is generated due to the interacting wedge surfaces 21 and 24.

To displace the clamping rings 22 in the direction a, adjusting elements are provided that can be adjusting screws or pins 25, for example.

According to the invention, one or more actuators 40 are provided that are connected with these adjusting elements for automatic positioning the stator 1 or are equipped with them. Proceeding from FIG. 1, this is shown schematically in FIG. 2.

Figure 2:
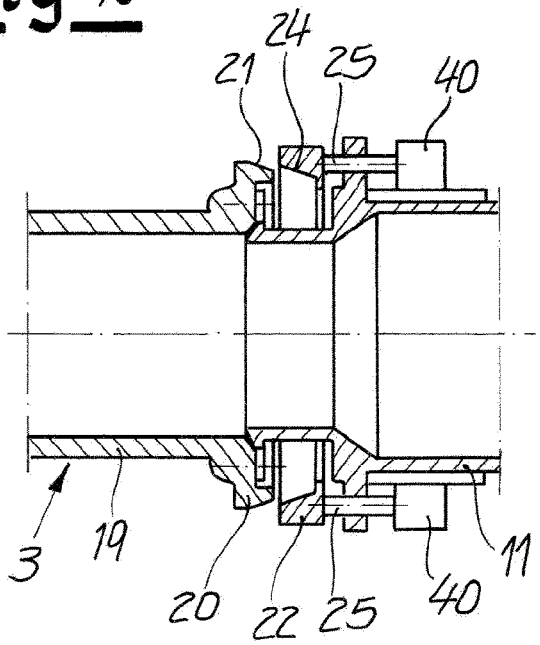
FIG. 2 shows a detail of the pump of FIG. 1 with drives.

There, stepper motors are shown as actuators 40 that act on the clamping ring 22 parallel to the axis through adjusting elements 25. The adjusting screws shown in FIG. 1 are consequently replaced by the linearly displaceable adjusting elements 25 in this embodiment. In this regard, it is practical to provide at least two, preferably at least three adjusting elements 25 for each clamping ring 22, and in this regard, also three respective actuators 40, so that a total of six adjusting elements are provided for the pump. The possibilities can be further optimized if four adjusting elements 25 are provided at each pump end and consequently a total of eight adjusting elements 25 are provided. In practice, a compromise will take place in this regard, between increasing the number of adjusting elements to improve positioning and the related control effort. In this regard, it is evident that the drive motors 40 are each attached to one housing part, for example to the connection adapters 11, 12. In this regard, an embodiment is shown in FIG. 2, in which the drive motors 40 move axially on illustrated rails. Forces are absorbed by these rails. Alternatively, however, the possibility also exists of fixing the motor itself, for example when using gear racks.

Figure 3:
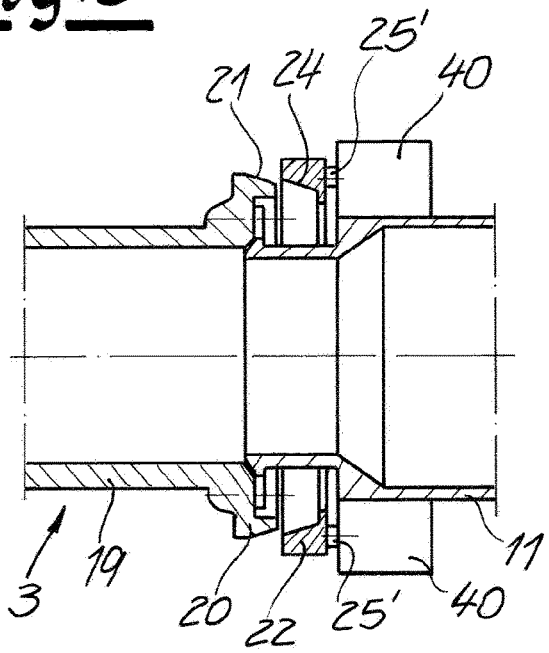
FIG. 3 shows a modified embodiment of the structure shown in FIG. 2, FIGS. 4, 5, and 6 are simplified views of the pump of FIG. 1 in modified embodiments.

An alternative embodiment is shown in FIG. 3, in which the drives 40 are configured not as stepper motors, but rather as cylinders, for example hydraulic cylinders or pneumatic cylinders. In this regard, adjusting elements 25' are formed by the pistons of these cylinders. The pistons of the cylinders 40 consequently press parallel to the axis on the respective clamping ring 22.

Figure 4:
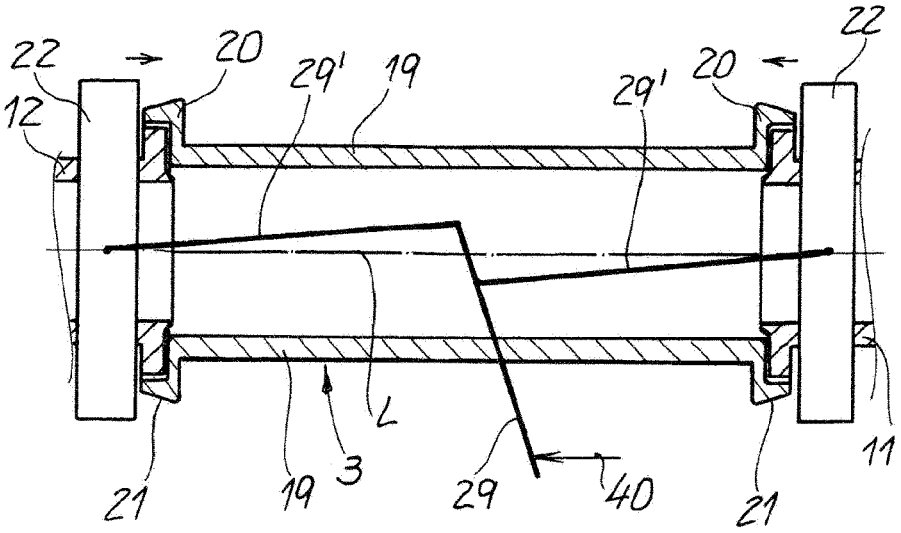

While the two clamping rings 22 on the two pump ends can be actuated separately and independently of one another according to FIGS. 1 to 3, FIG. 4 shows an embodiment in which the two clamping rings 22 are clamped against one another by one or more drives 40. Thus, FIG. 4 shows an embodiment in which the two clamping rings 22 can be displaced by a lever linkage. For this purpose, at least one push/pull connector rod or connection rod 29' is connected with each clamping ring 22, and the two connection rods 29' are connected with one another via a common clamping lever 29. In FIG. 4, only one such lever arrangement is shown in this regard. An identical lever arrangement is provided on the opposite unillustrated side. The clamping or activation lever 29 can be tilted by the drive 40, and thereby the two clamping rings 22 can be pressed together. In FIG. 4, the drive is merely shown schematically. Because a clamping lever 29 is preferably provided on each end of the pump the possibility exists of providing a separate drive for each clamping lever 29. Preferably, however, the two clamping levers 29 will be coupled with one another and acted on by a common drive.

Figure 5:
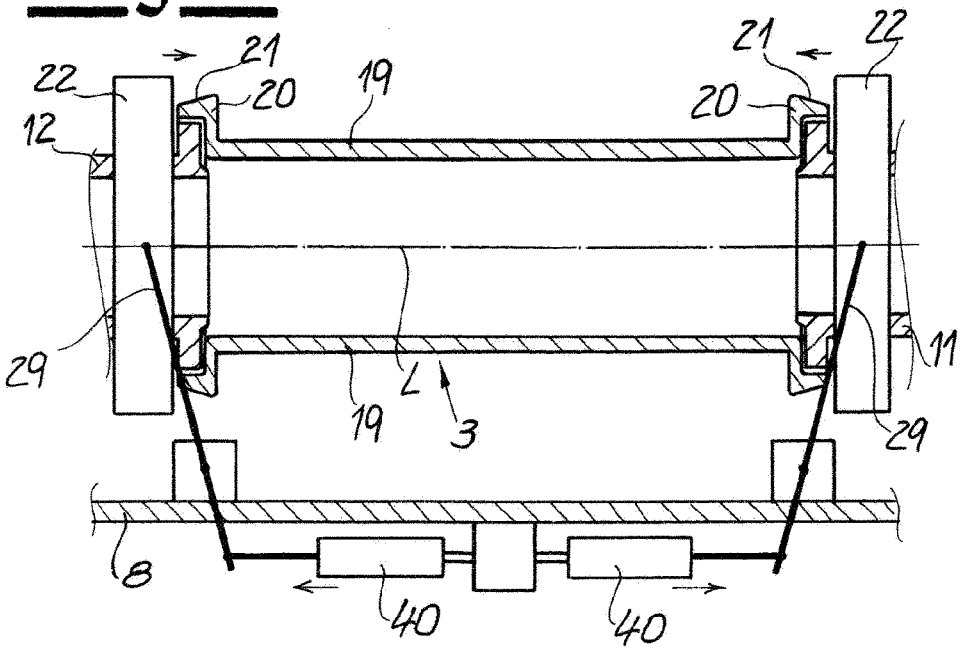

Here according to FIG. 5, clamping levers 29 are also connected with the clamping rings 22, and here, however, each clamping lever 29 itself can be actuated by a respective drive 40. The two drives 40 shown can be cylinders (hydraulic cylinders, for example) or threaded spindles that can be attached by a coupling below the base plate 8, for example. In this embodiment, consequently each clamping ring can be displaced and thereby operated separately by the respective drives 40. In a modified embodiment, however, the possibility also exists in the arrangement according to FIG. 5 to connect the two clamping levers 29 with one another with the interposition of a common drive, and to clamp the two clamping rings 22 against one another in this manner. Furthermore, in FIG. 5, as well, only the arrangement for the visible side of the pump is shown. On the unillustrated opposite side, another such arrangement with clamping levers 29 can be provided. These can then be separately actuate using respective drives, or, alternatively, common drives can also be used.

Figure 6:
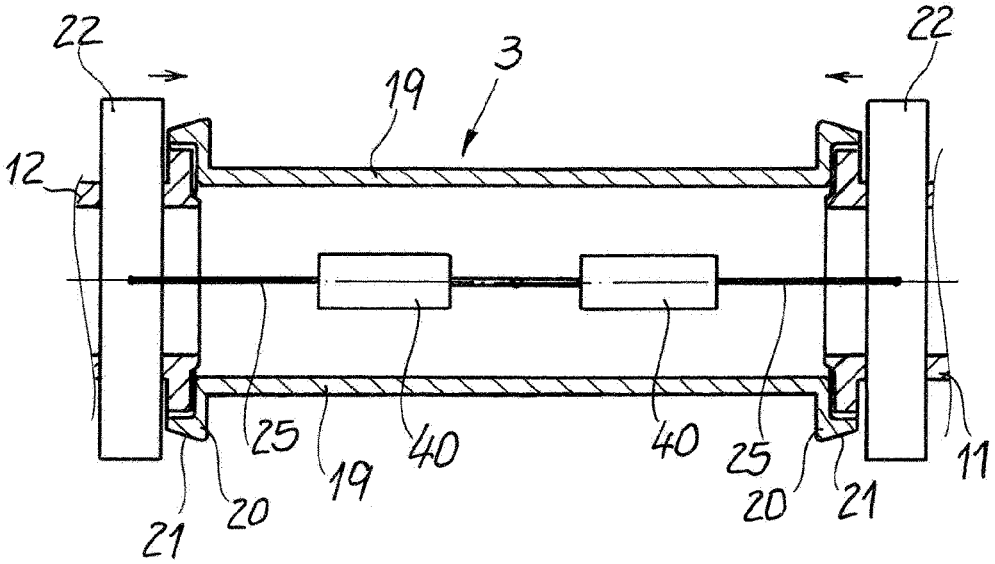

According to FIG. 6, the two clamping rings 22 can be adjusted by linear motors 40 that are each connected with the clamping rings 22 through respective adjusting elements 25. However, the linear motors 40 shown there can also be replaced with other actuators, for example cylinders. The arrangement that can be seen in the figure, with adjusting elements 25 and motors 40, is also provided on the unillustrated opposite side.

Figure 7:
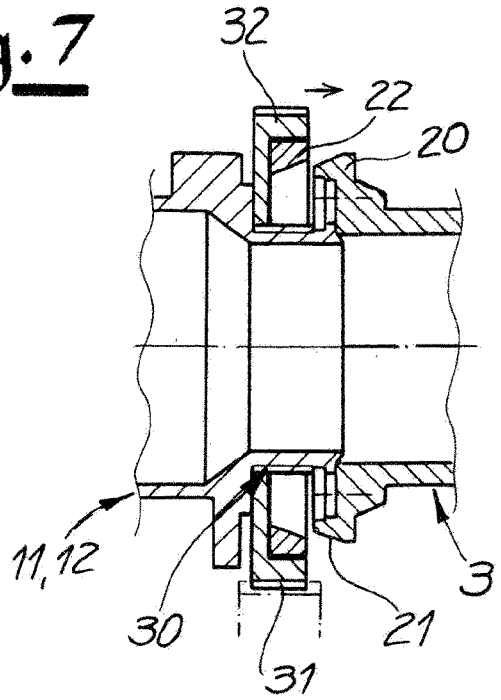
FIG. 7 is a detail from a modified embodiment of the pump of FIG. 1.

FIG. 7 shows a modified embodiment in which a rotatable adjusting ring 32 is provided as an adjusting element. This ring is mounted so as to rotate and is axially displaced on such rotation. For this purpose, the adjusting ring is mounted on the respective housing part or connection adapter 11, 12 by a screwthread 30. On rotation of the adjusting ring 32, the ring moves on the housing part or the adapter 11, 12 axially, because of the screwthread 30, so that in this way, the clamping ring 22 is thereby displaced with the wedge surfaces, and the housing segments are clamped. Here according to FIG. 7, only the adjusting ring consequently rotates, and the clamping ring 22 is only moved axially. The adjusting ring 32 can consequently rotate not only relative to the housing, but also relative to the clamping ring 22. To actuate the rotatable adjusting ring 32, the ring has gear teeth 31 on its outer periphery, so that a n unillustrated drive can act on the adjusting ring 32 on its outer periphery through a drive pinion. Automated positioning according to the invention also is effective in this way.

Figure 8:
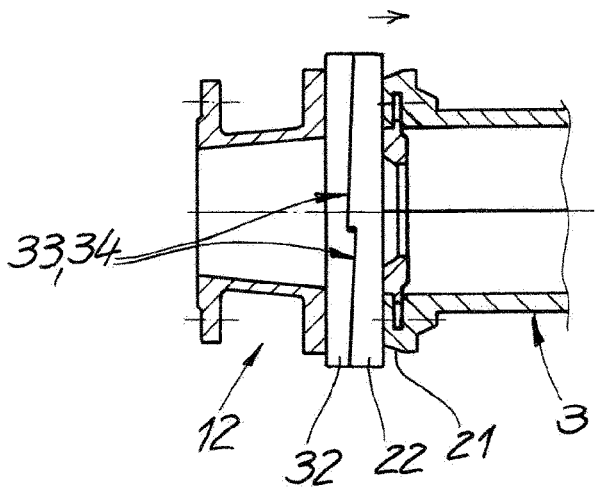
FIG. 8 is another detail from a further embodiment of the pump of FIG. 1.

A comparable concept is implemented here according to FIG. 8. There, a separate, rotatable adjusting ring 32 is also provided as an adjusting element. On rotation of the adjusting ring 32, the clamping or cone ring 22 with the unillustrated wedge surfaces 24 is displaced axially. For this purpose, the adjusting ring 32 has one or more angled surfaces 33 on its side facing the clamping ring 22. The clamping ring 22 has complementary angled faces 34 in the form of slanted surfaces on its surface facing the adjusting ring 32. These angled faces 33 and 34 interact in such a manner that on rotation of the adjusting ring 32, the clamping ring 22 is displaced axially. In contrast to the embodiment according to FIG. 7, here only the clamping ring 22 moves only axially, while the adjusting ring 32 only rotates. In this embodiment, as well, the possibility exists of providing the adjusting ring 32 with outside gear teeth so that a drive can mesh with it. Alternatively here according to FIGS. 7 and 8, however, linear adjusting elements can also act on the adjusting ring tangentially. This is not shown. Furthermore, the clamping ring 22 is not shown in section in FIG. 8 (also not in FIGS. 4, 5, and 6), so that the clamping surfaces 24 provided on the clamping ring 22 cannot be seen in these figures.

Figure 9:
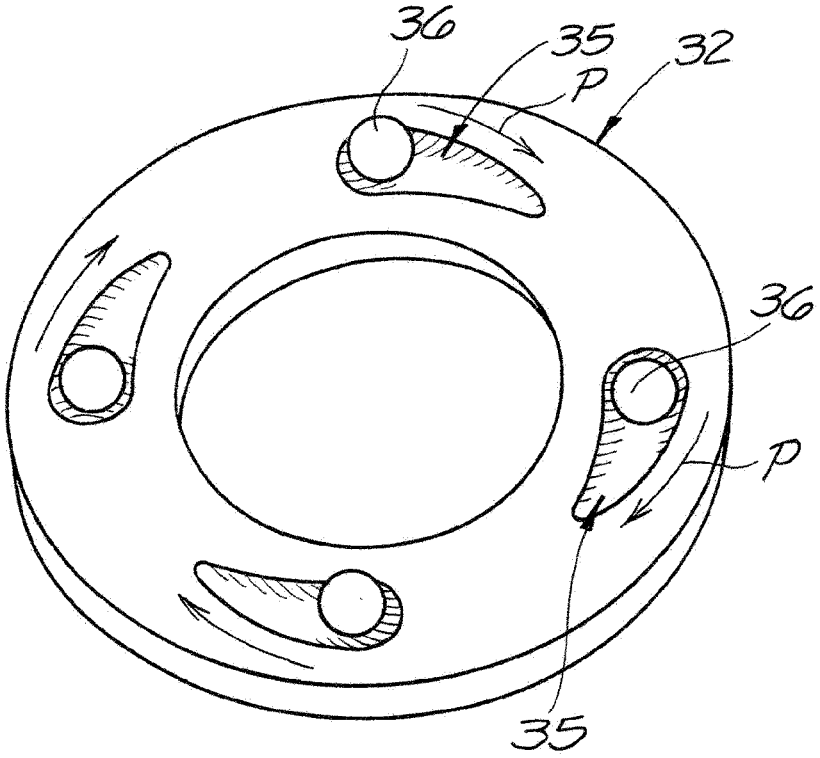
FIG. 9 shows a further modification of the invention.

The concept shown in FIGS. 7 and 8 with a rotatable adjusting ring can be varied according to FIG. 9. There, the rotatable adjusting ring 32 has multiple recesses 35 that are guide tracks and in which is held a body or sliding body, for example a ball 36. These balls 36 bear axially against the clamping ring 22. The guide tracks are pocket-like guide grooves 35 whose depth decreases angularly from one end of the groove to the other end of the groove, in the direction of the arrow P, so that the rolling bodies, for example balls, lie on the rising groove floor on rotation. Alternatively, other rolling bodies, for example cylinders, or basically also sliding bodies can be used. Furthermore, in FIG. 9 only the adjusting ring 32 with the guide grooves 35 is shown. The possibility exists that the clamping ring is also equipped with complementary opposite guide tracks on the surface facing the adjusting ring, so that the balls 36 are then guided both in the guide tracks 35 of the adjusting ring and in the unillustrated complementary guide tracks of the clamping ring.

Figure 10:
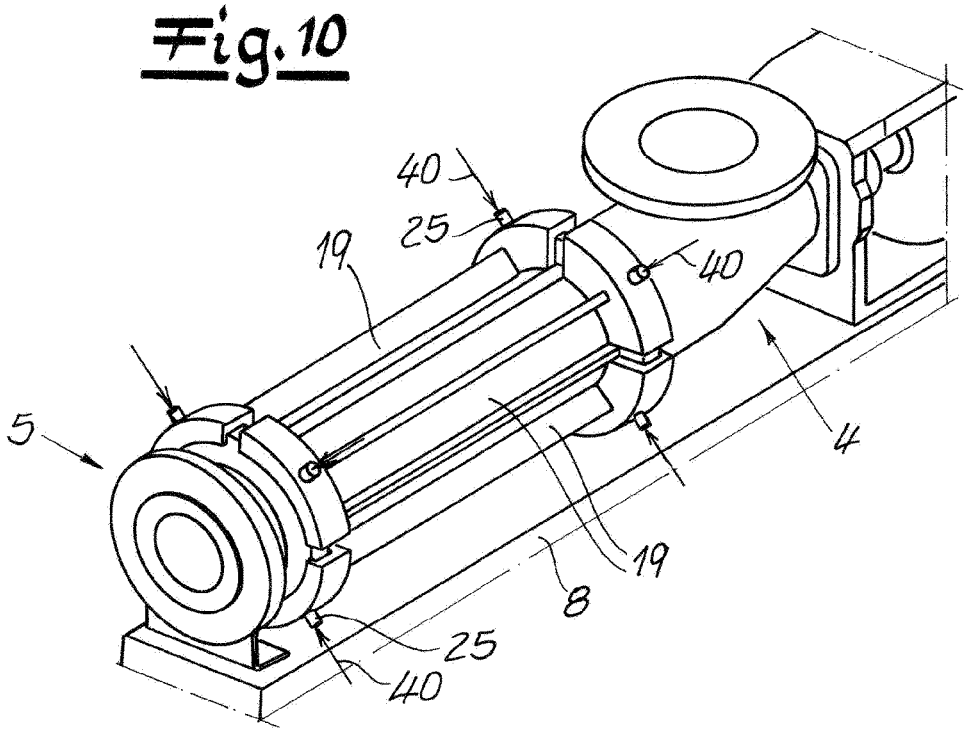
FIG. 10 shows an alternative embodiment with radial adjusting elements.

A modified embodiment is shown in FIG. 10. This pump corresponds to the pump known from WO 2009/024279 [U.S. Pat. No. 8,429,659], with radially oriented adjusting screws or adjusting elements 25. In turn, actuators 40 can act on these adjusting elements 25. This is merely shown in FIG. 10.

The drives 40, which are shown schematically in the figures, are critical to the invention, since they actually allow automated positioning of the clamping elements, for example the clamping rings. These drives are preferably equipped with controllers and connected with controllers that drive the drives as a function of status data or operating parameters of the eccentric screw pump. However, sensors can also be provided that provide such status data. No details are shown in the figures.

Figure 11:
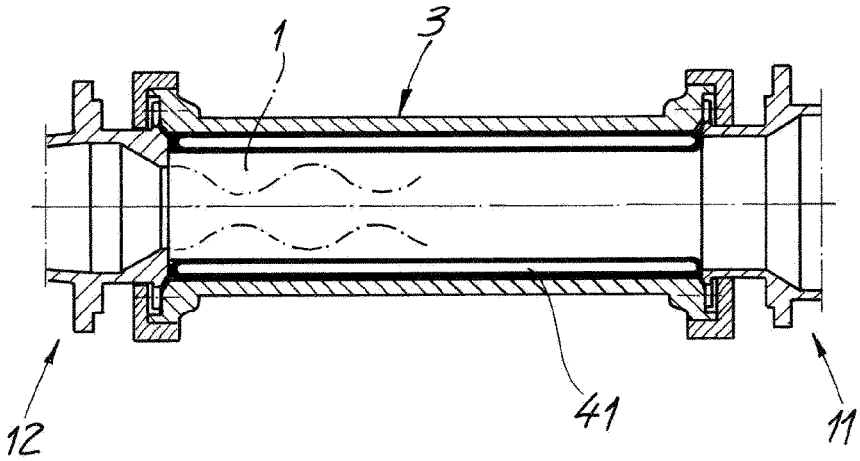
FIG. 11 shows a modified embodiment of an eccentric screw pump with integrated activation cushions.

An alternative embodiment is shown in FIG. 11. In this embodiment, clampable housing segments are completely eliminated. Consequently, the stator-clamping device is not provided with housing segments, but rather by intermediate elements between the stator housing 3 and the stator 1. Here, these intermediate elements are cushions that change in volume, for example hydraulic cushions 41 that are provided between the stator housing 3 and the stator 1. This embodiment is also practical in the case of an axially split stator. It is also possible to work with an axially split stator housing 3 or housing segments 19. However, this embodiment can also be implemented with a one-piece stator housing. The hydraulic cushions 41 can also be controlled automatically and remotely, so that with such an embodiment, as well, adaptation of the geometry to specific operating parameters is possible.

The invention claimed is:

1. An eccentric screw pump comprising:

at least one stator of elastic material and extending along an axis;

a rotor rotatable about the axis in the stator;

an axially split stator housing at least partially surrounding the stator and, formed by at least two housing segments; and a stator-clamping device for pressing the housing segments radially against the stator and thereby pressing the stator against the rotor, the device having one or more movable adjusting elements that bear radially inward on the housing segments for radially adjusting and clamping the stator, and one or more actuators connected or provided with the adjusting elements for automatically positioning the housing segments.

2. The eccentric screw pump according to claim 1, further comprising:

a controller connected to the actuators for operating the actuators as a function of status data or operating parameters of the eccentric screw pump.

3. The eccentric screw pump according to claim 2, wherein the controller is connected with a pump drive or a pump drive controller or is integrated thereinto, and the actuators are driven by the controller as a function of drive power consumed, motor current, or other operating parameter of the pump.

4. The eccentric screw pump according to claim 2, wherein the adjusting elements are driven by the controller as a function of one or more measurement values recorded by one or more sensors connected with the controller.

5. The eccentric screw pump according to claim 4, wherein the sensors are temperature sensors, pressure sensors or through-flow sensors.

6. The eccentric screw pump according to claim 1, wherein the actuators are electrical or electric motor drives, hydraulic drives, or pneumatic drives.

7. The eccentric screw pump according to claim 1, wherein the adjusting elements are adjusting screws, pins, or rods actuatable by the actuators.

8. The eccentric screw pump according to claim 7, wherein the adjusting screws or pins and the actuators act on the housing segments radially.

9. The eccentric screw pump according to claim 7, wherein the stator-clamping device includes an axially displaceable cam ring bearing radially on wedge-like cam faces of the housing segments and the adjusting screws or pins and the actuators bear axially on this axially displaceable clamping ring.

10. The eccentric screw pump according to claim 1, wherein the adjusting elements include clamping levers and axially displaceable clamping rings engaging the housing segments and operated by the clamping levers.

11. The eccentric screw pump according to claim 1, wherein the adjusting elements include:

at least one threaded adjusting ring rotatable about the axis, an axially displaceable adjusting ring threaded on the rotatable ring and engaging the housing segments such that on rotation of the threaded ring the axially displaceable ring cams the housing segments radially inward or outward.

* * * * *